US005982338A

United States Patent [19]

Wong

[11] Patent Number: 5,982,338

[45] Date of Patent: Nov. 9, 1999

[54] RECTANGULAR COAXIAL LINE TO MICROSTRIP LINE MATCHING TRANSITION AND ANTENNA SUBARRAY INCLUDING THE SAME

[75] Inventor: Joseph S. Wong, Upland, Calif.

[73] Assignee: Raytheon Company, Lexington, Mass.

[21] Appl. No.: 08/986,869

[22] Filed: Dec. 8, 1997

[51] Int. Cl.[6] ..... H01Q 21/00; H01P 5/08

[52] U.S. Cl. ..... 343/853; 333/33

[58] Field of Search ..... 333/33, 34, 245, 333/246, 260; 439/63, 581; 343/853

[56] References Cited

U.S. PATENT DOCUMENTS

| | | | |
|---|---|---|---|
| 3,201,721 | 8/1965 | Voelcker | 333/33 |
| 3,686,624 | 8/1972 | Napoli et al. | 333/33 X |
| 5,418,505 | 5/1995 | Agarwal et al. | 333/33 |
| 5,703,599 | 12/1997 | Quan et al. | 333/246 X |

OTHER PUBLICATIONS

*Microwaves,* Apr., 1968, pp. 52–56, "Why Not Use Rectangular Coax?", W.S. Metcalf.

*Primary Examiner*—Paul Gensler
*Attorney, Agent, or Firm*—Leonard A. Alkov; Glenn H. Lenzen, Jr.

[57] ABSTRACT

A microwave circuit including a rectangular coaxial transmission line, a microstrip transmission line and a wideband transition section for transitioning between the rectangular coaxial and microstrip lines. The transition section includes a capacitive section which cancels inductive reactance caused by physical discontinuities at the transition junction. The transition section includes a conductive tab extending from the rectangular coaxial center conductor which is electrically connected to the microstrip conductor line. The capacitive section can take the form of a dielectric disk of greater dielectric constant than that of the rectangular coaxial dielectric section, or an area of increased cross-sectional dimension of the rectangular coaxial center conductor.

18 Claims, 9 Drawing Sheets

RECTANGULAR COAXIAL LINE TO MICROSTRIP LINE MATCHING TRANSITION AND ANTENNA SUBARRAY INCLUDING THE SAME

TECHNICAL FIELD OF THE INVENTION

This invention relates to microwave devices, and more particularly to transition structures for transitioning between a rectangular coaxial transmission line and a microstrip line.

BACKGROUND OF THE INVENTION

Two common types of microwave transmission lines are coaxial transmission lines and microstrip transmission lines. A special type of coaxial line is known as rectangular coaxial line, or "square-ax" line. In this type of line, an outer conductor shield having a rectangular cross-sectional configuration is used instead of an outer conductor shield with a circular cross-section for conventional coaxial line. The inner conductor for rectangular coaxial line can also have a rectangular cross-section, or a circular cross-section. Rectangular coaxial lines are described, for example, in *Microwaves*, April, 1968, pp. 52–56, "Why Not Use Rectangular Coax?", W. S. Metcalf.

It is desirable for some applications to use more than one type of transmission line to go from circuit to circuit, or from device to device for signal propagation. There is therefore a need to provide a transition between circuits or devices which include different types of transmission lines, and particularly square-ax and microstrip transmission lines. One problem is the significant mismatch encountered at the interface between the two transmission lines due to the physical discontinuity.

Matching between a circular coaxial transmission line and a microstrip line has been attempted by trial and error, typically changing part of the center conductor diameter to different sizes or adding stubs at the microstrip input. This type of matching is acceptable for narrowband applications (15 to 20% bandwidth). However, it is difficult to achieve wideband operation, i.e. over an octave frequency range, with trial and error approaches.

There is therefore a need for a transition between square-ax or rectangular coaxial transmission line and microstrip transmission line that is broadband and has low loss.

SUMMARY OF THE INVENTION

In accordance with an aspect of the invention, a microwave circuit is described, and includes a square-ax transmission line section including a square-ax dielectric member having a rectilinear cross-sectional configuration and a square-ax center conductor extending through an opening formed in the dielectric member. A microstrip transmission line section includes a dielectric substrate having a microstrip conductor line defined on a first surface of the substrate and a ground plane formed on a second surface of the substrate. A wideband transition section is provided for electrically connecting the square-ax transmission line section and the microstrip transmission line section. The transition section includes a conductive tab in electric contact between the square-ax center conductor and the microstrip conductor line, and a capacitive section for canceling the inductance reactance resulting from the physical discontinuity at the transition.

In one embodiment, the capacitive section includes a thin dielectric disk of the same cross-sectional configuration and size as the dielectric section of the square-ax, but formed of a material which has a higher dielectric constant than the dielectric material forming the square-ax dielectric section. In another embodiment, the capacitive section includes a region of increased diameter of the square-ax center conductor. This region can be formed either by a metal ring which fits over the end of the square-ax conductor, or by forming the end of the square-ax conductor to include an end portion of increased diameter.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

This invention is directed to a transition between a square-ax transmission line and a microstrip transmission line, which is characterized by a wideband matching capability. In accordance with one aspect of the invention, the matching is accomplished by providing a thin dielectric ring which slides onto the end of the square-ax center conductor, and where the same thickness of dielectric around the center conductor is removed. In accordance with another aspect of the invention, a metal ring can alternatively be employed which becomes part of the square-ax center conductor.

Figure 1:
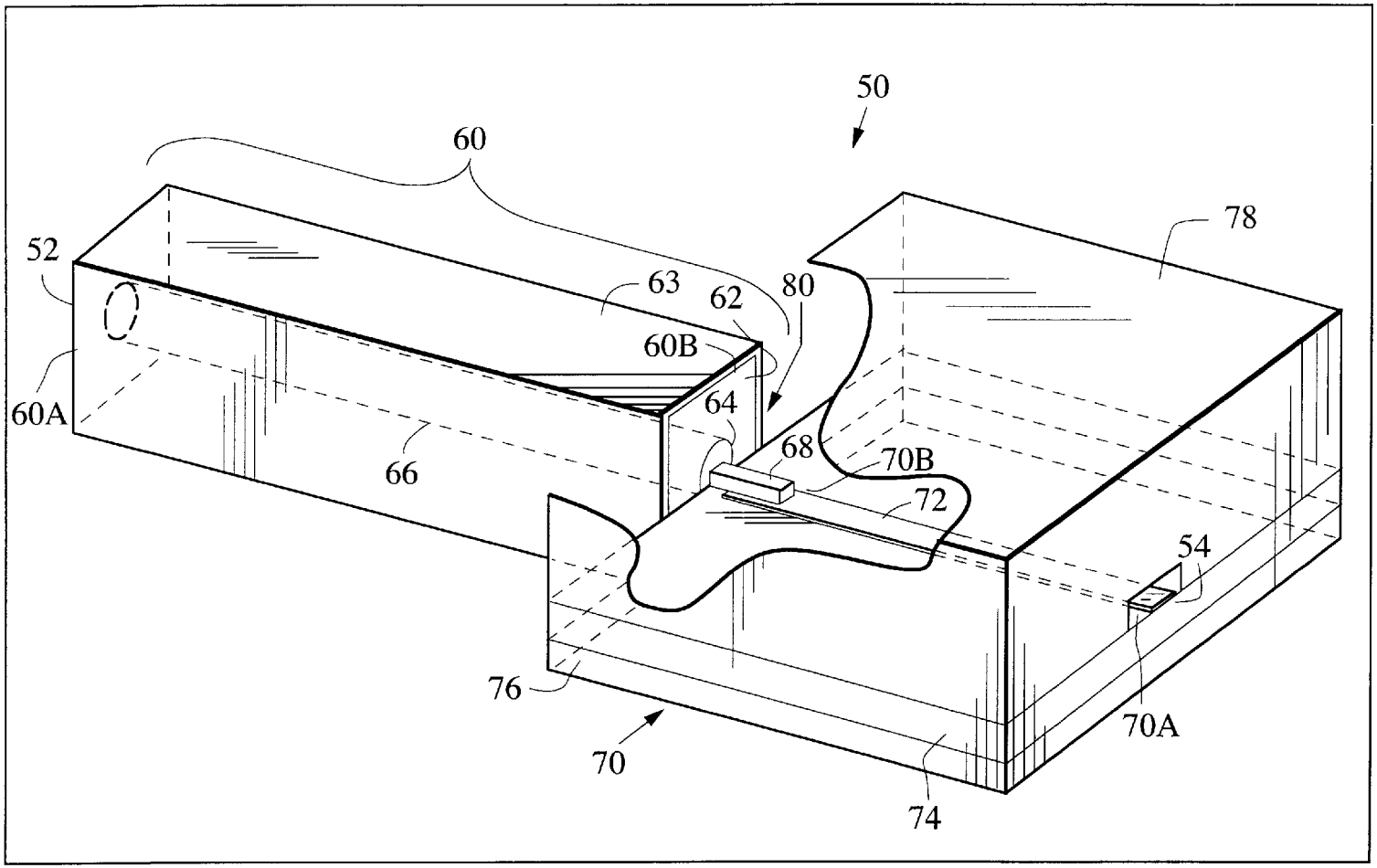
FIG. 1 is an isometric view of an unmatched RF circuit including a square-ax transmission line, a microstrip transmission line, and a transition between the two transmission line.

FIG. 1 is a three-dimensional perspective diagram showing a microwave circuit 50 including a square-ax transmission line section 60, a microstrip transmission line section 70, and a transition section 80 for making an electrical transition between the two transmission lines. The device 50 includes a first port 52 at a first end 60A of the square-ax section 60, and a second port 54 at a first end 70A of the microstrip section 70.

The square-ax section has a first end 60A and a second end 60B. In this exemplary embodiment, the square-ax transmission line section 60 is a one-half inch long section, comprising a 0.116 inch by 0.116 inch square section of solid dielectric 62, and an outer conductor shield 63 covering the exterior surface of the dielectric 62. The dielectric section 62 has a central longitudinal opening 64 formed therein, in which a center metal conductor 66 is disposed. The center conductor in this exemplary embodiment has a circular cross-section with a diameter of 0.035 inch, and the solid dielectric has a dielectric constant $e_r$ of 2.54 (equivalent to Rexolite (TM)). The square-ax transmission line can be fabricated using a molding process to mold the dielectric section 62 into two pieces split along a longitudinal axis of the section, with a groove formed in each piece to accept the center conductor. The two dielectric pieces can then be assembled together with the center conductor in place. One exemplary dielectric material suitable for this molding technique is FR-TPX, marketed by Mitsui Petrochemical Industries, Ltd. Of course, other techniques for making the square-ax transmission line could alternatively be used, such as machining the solid dielectric material into the appropriate form, and boring a hole in which to place the center conductor.

The microstrip transmission line 70 in this exemplary embodiment includes a 0.025 inch wide conductor line 72 printed on the top surface of a 0.025 inch thick dielectric substrate 74 which has a dielectric constant of about 9.5. A ground plane 76 is printed on the bottom surface of the substrate 74. A metal cover 78 provides a shield which substantially encloses the microstrip transmission line section 70. Openings are formed in the metal cover adjacent the microstrip line first and second ends to provide access to the microstrip conductor by the transition tab and by a connector (not shown) or other transition device at the first end of the microstrip line without shorting the tab or connector conductor to the shield. The opening at the transition interface is the same size as the square-ax outer conductor 63.

Figure 2:
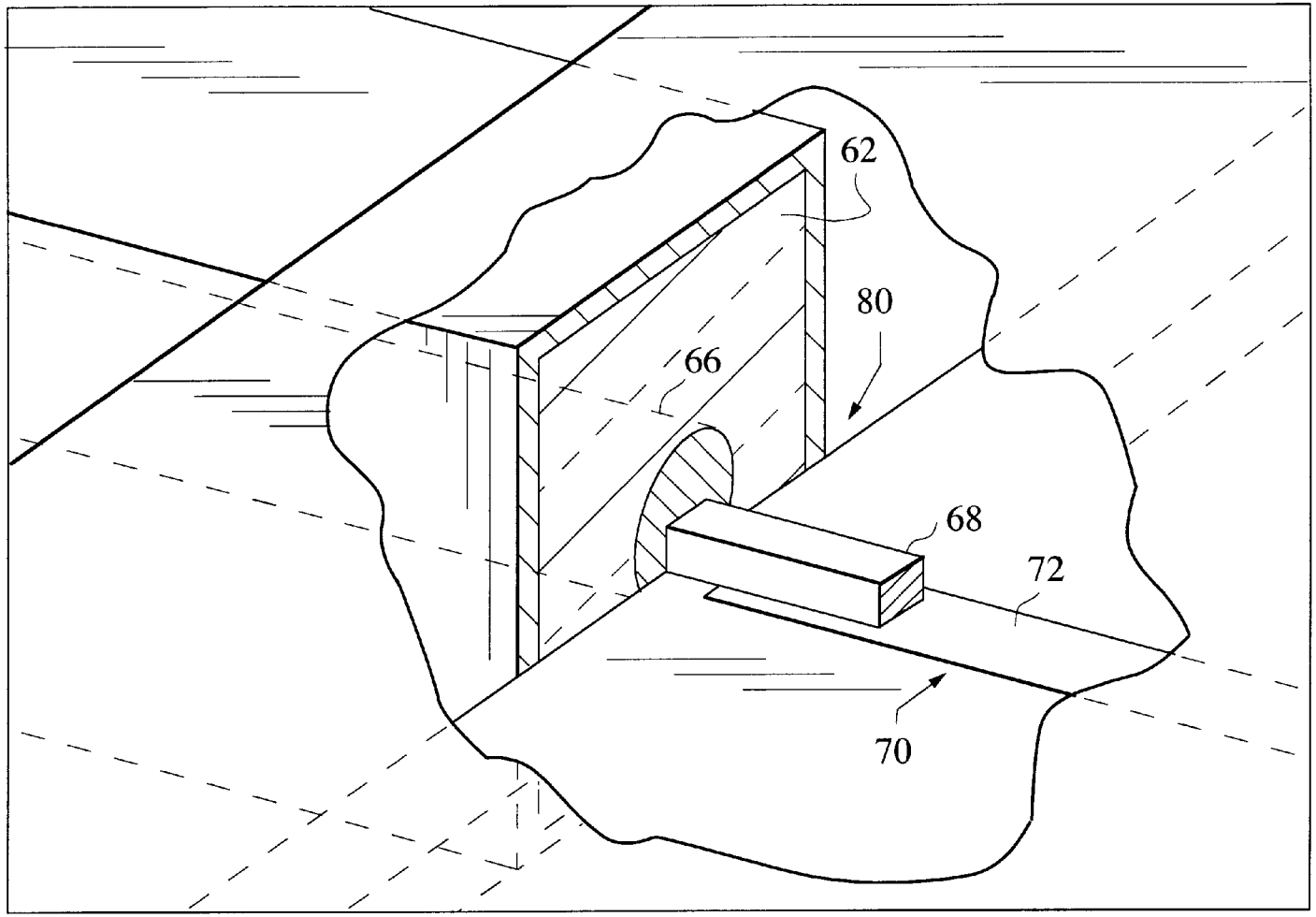
FIG. 2 is an enlarged view of the transition section of the circuit of FIG. 1.

At the second end 60B of the square-ax transmission line section where the transition 80 starts, the center conductor 66 is cut to a shape which has a rectangular cross section of 0.010 inch high by 0.015 inch wide and a length of 0.050 inch. This part 68 of the conductor will be referred to herein as the "tab." At the transition 80, this tab 68 makes direct contact with the microstrip conductor line 72, and is typically soldered to the conductor line. This is shown in further detail in the enlarged partial view of FIG. 2.

The tab 68 can alternatively be wire bonded or ribbon bonded to the microstrip, in which case the length of the element would be different.

Both the square-ax transmission line 60 and the microstrip transmission line in this exemplary embodiment have characteristic impedances of approximately 50 ohms. Although the impedance of the system is matched, the return loss performance is poor, especially at the higher frequencies, due to its large discontinuity (from the tab to the microstrip input) at the transition. This can be seen from the simulation plot shown in FIG. 3, as curve A, where at 5 GHz the return loss is 25.6 dB and at 15 GHz it went up to 12.6 dB. (FIG. 3 was generated by use of the ANSOFT HFSS (High Frequency Structure Simulator) software program, marketed by ANSOFT Corporation.) The task is to bring the return loss at the high end down so that the return loss can be flat across the 5 GHz to 15 GHz range. Even though this would be considered quite impossible to do in the past, due to the difficulty in canceling the reactive impedance caused by the large physical discontinuity at the transition, this invention has solved the problem.

Figure 3:
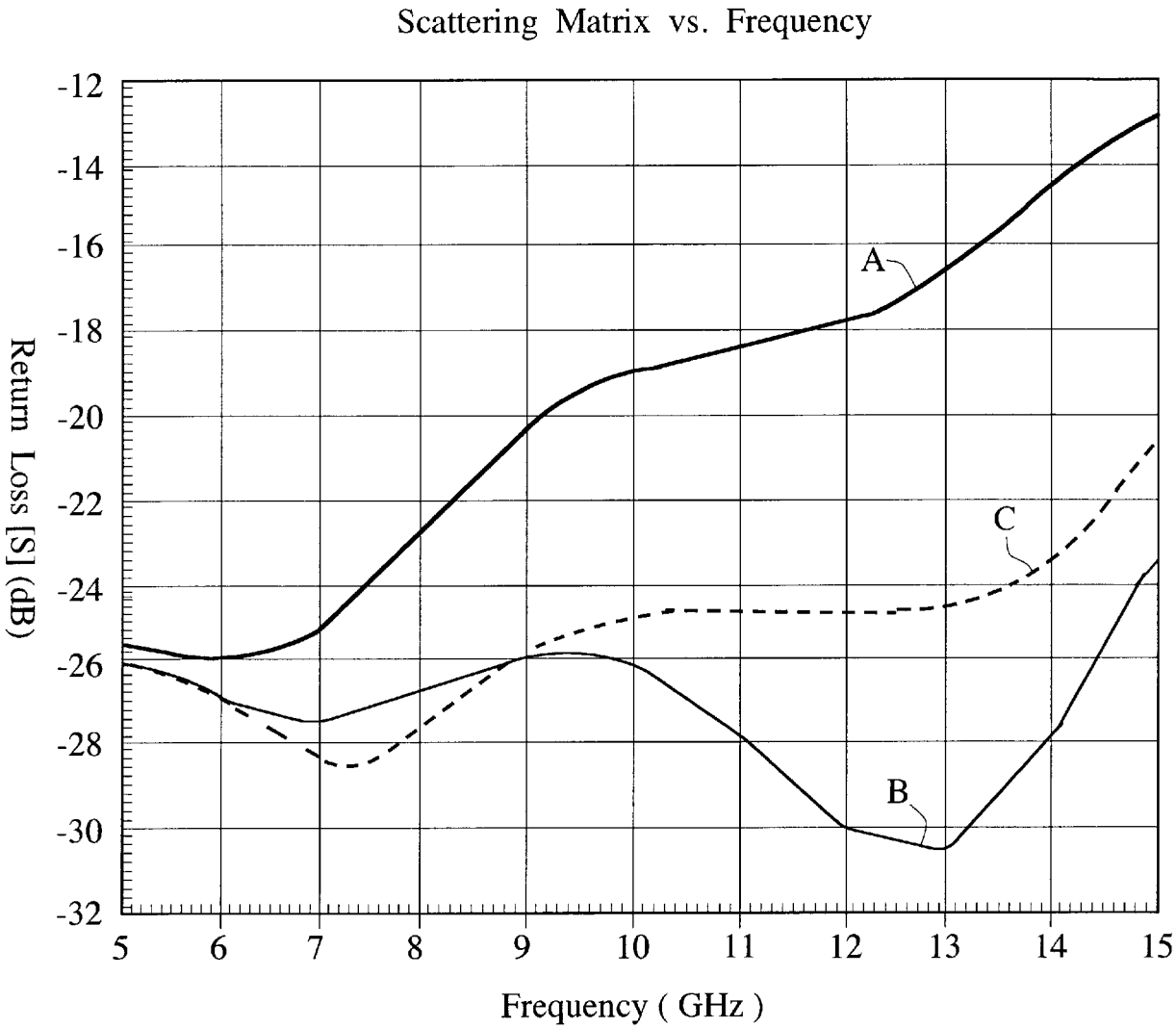
FIG. 3 is a graph plotting return loss as a function of frequency for several transition embodiments.
Figure 5:
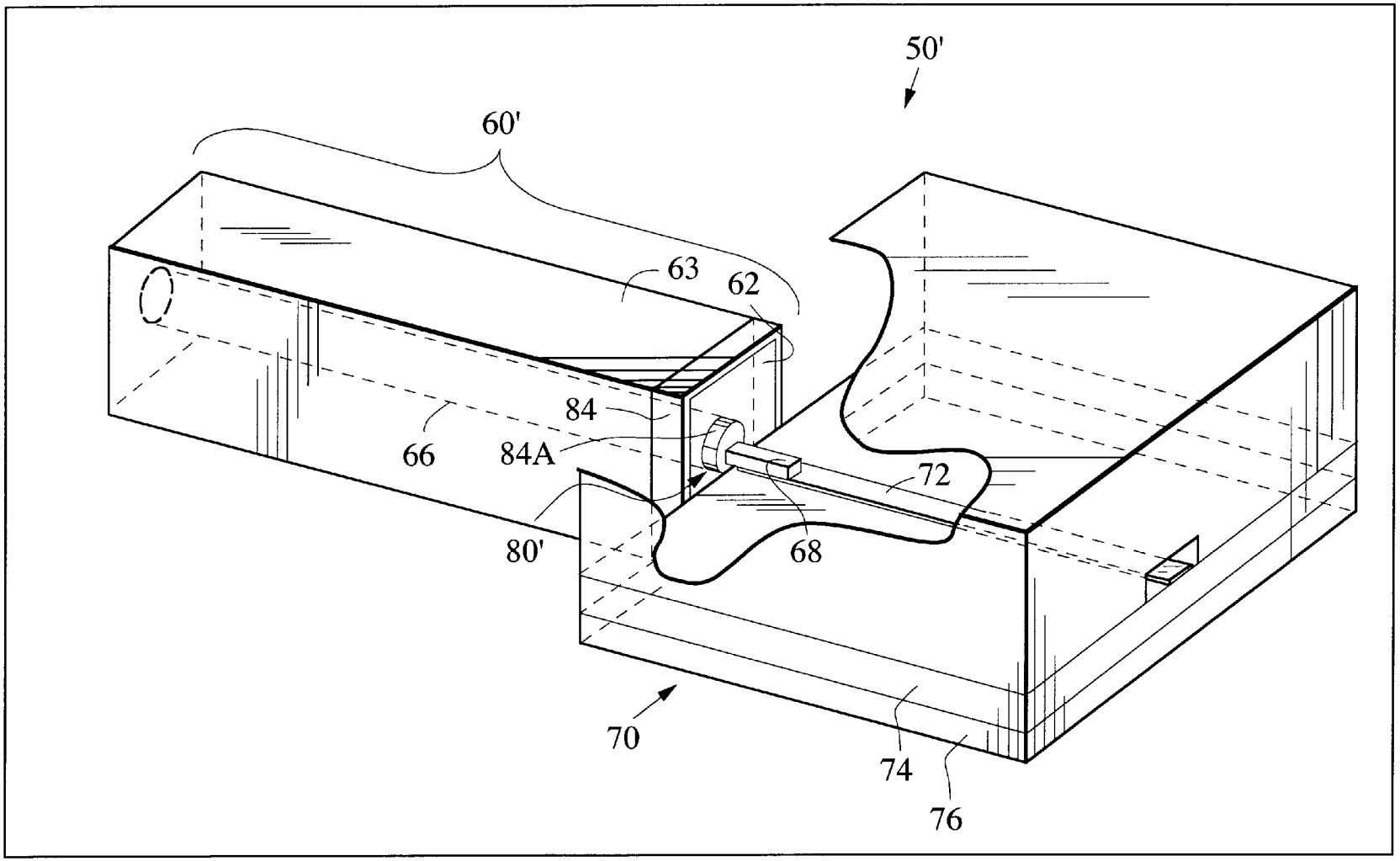
FIG. 5 is an isometric view of an RF circuit including a square-ax transmission line, a microstrip transmission line, and a transition between the two transmission lines with a dielectric matching element in accordance with an aspect of the invention.
Figure 6:
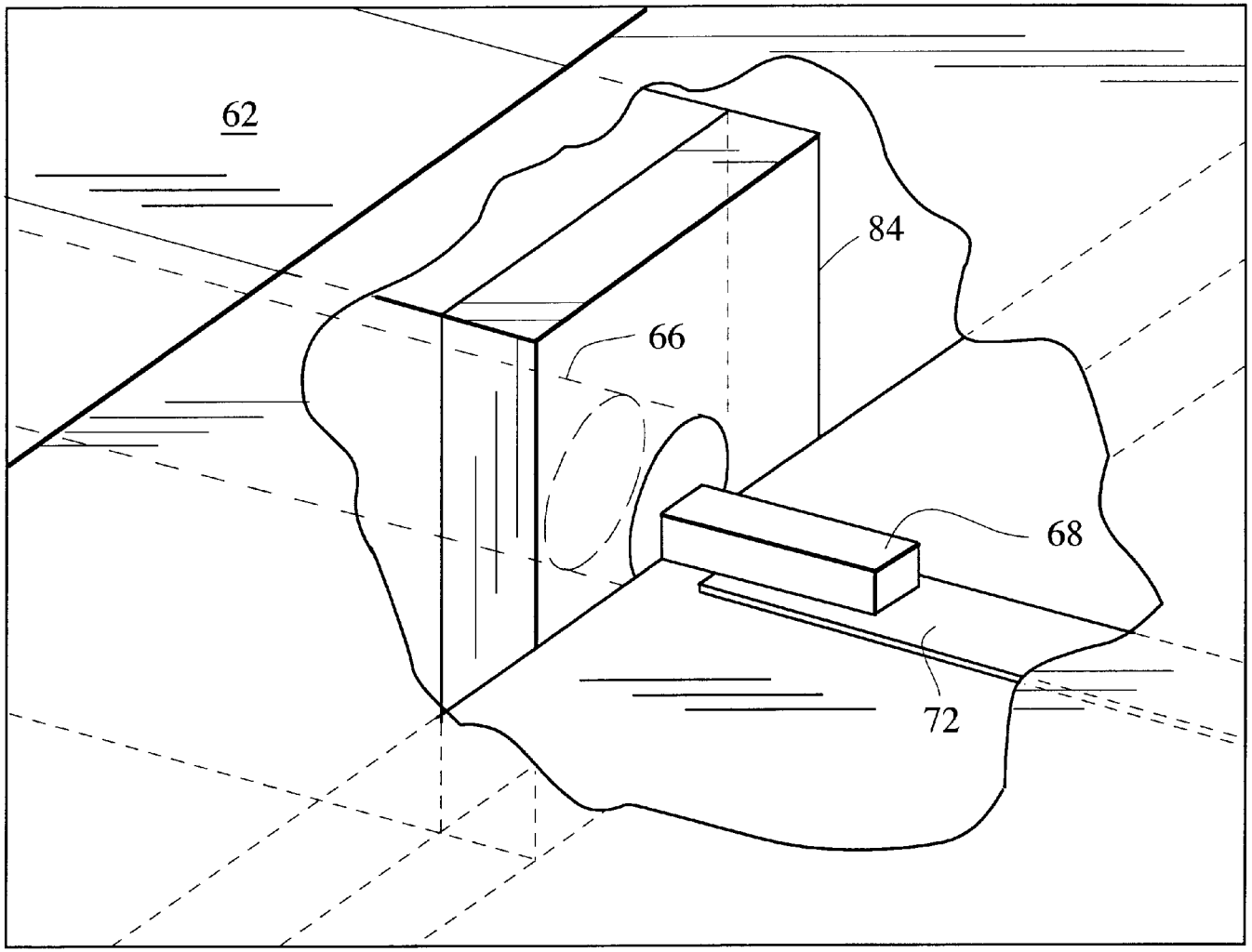
FIG. 6 is an enlarged view of the transition section of the circuit of FIG. 5.

An exemplary technique in accordance with an aspect of the present invention is shown in FIGS. 5 and 6. The circuit 50' includes a square-ax section 60', a microstrip section 70, and a transition section 80'. The transition section 80' includes a rectangular, thin dielectric layer 84 which has the same cross-sectional size and shape of the square-ax dielectric 62, and has a center opening 84A, is slid onto the center conductor 66 and placed at the round end of the tab 68. The layer 84 has a length of 20 mils in this embodiment, and is fabricated of a dielectric material which is different than the material of dielectric element 62, and which has a larger dielectric constant than the material of element 62. The layer 84 functions as a capacitance disk. The optimum dielectric constant for this layer in this exemplary embodiment was found to be 6 for the best match. The match is shown in FIG. 3, as curve B. The reason this design can provide such a wideband match is that the capacitance disk cancels out the highly inductive part of the reactance seen at the transition junction. This inductive reactance results from the physical discontinuity of the square-ax conductor and microstrip conductor line.

Figure 4:
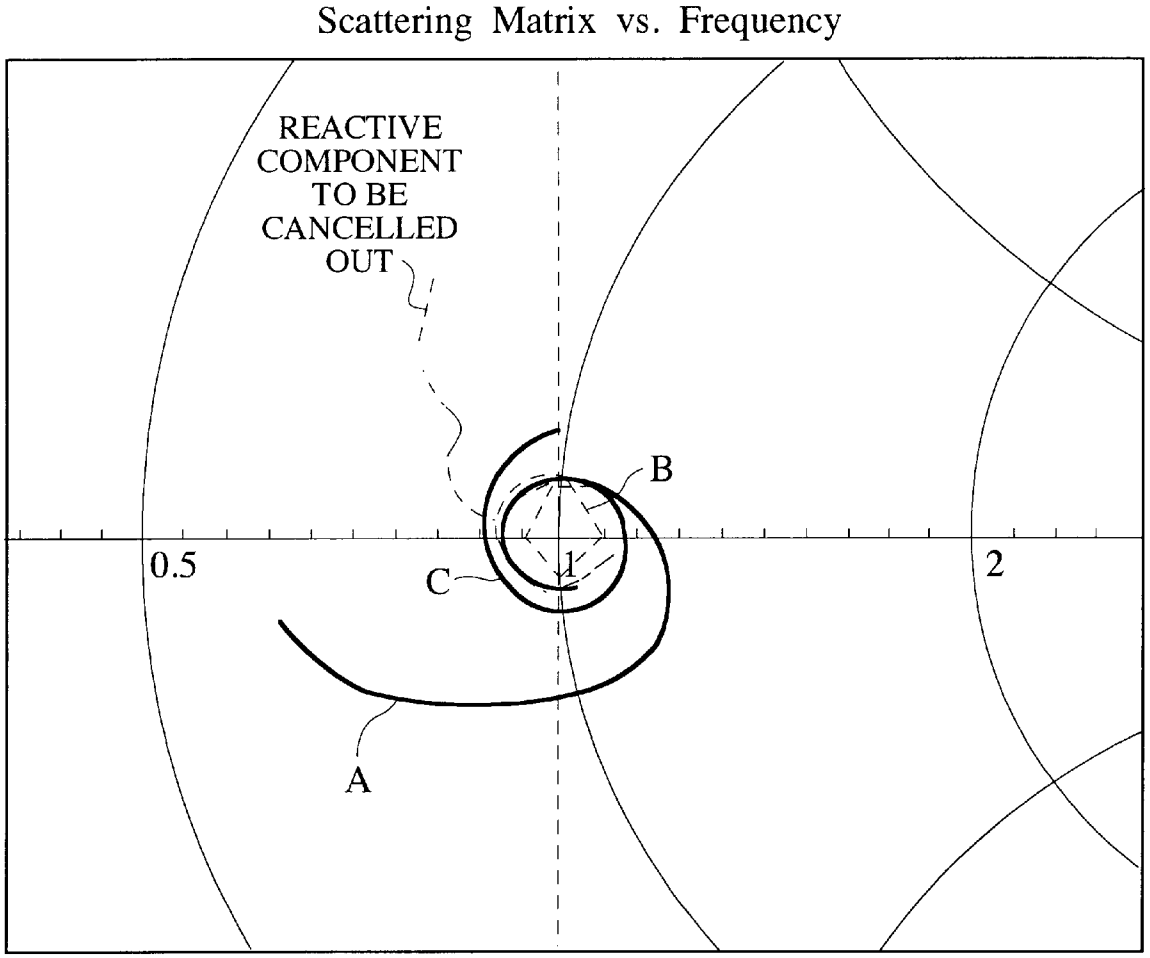
FIG. 4 is a portion of a Smith chart showing impedances of three transition embodiments.

The thickness and dielectric constant for the dielectric layer 84 can be determined in accordance with the following procedure. In order to determine what type of matching is required, the first step of the procedure is to model the unmatched circuit of FIG. 1 using a high frequency structure simulator computer program, such as the ANSOFT HFSS program. From the simulation results, the impedance or the S- parameters of the square-ax/microstrip junction is plotted on a Smith chart, as illustrated in the partial expanded Smith chart shown in FIG. 4. The simulator program is able to calculate the impedance or the magnitude and phase of the reflection coefficient at the junction, by de-embedding the length of transmission line from port 1 of the square-ax transmission line to the junction. It can be seen on the Smith chart that the impedance of the junction is highly inductive. Thus, to cancel out the inductive reactance, some type of capacitance or capacitive element is required at the junction. The dielectric layer 84 is used for this purpose, and the proper size and dielectric constant is determined.

It is to be appreciated that the dielectric layer 84 must have a thickness of only a small fraction of a wave-length (in the dielectric medium) at the center frequency of operation. In fact, the range of between 0.025 $\lambda$ and 0.05 $\lambda$ has been found to be a suitable thickness range. The layer is not intended to operate as a quarter-wave transformer, and so the thickness is kept well under a quarter wavelength. An optimum thickness for a given application can be found through iterative simulation. For the exemplary embodiment of FIGS. 5 and 6, this thickness is 0.020 inch. Similarly, the optimal dielectric constant for a given application can be determined by iterative simulation, using different dielectric constant values for given layer thicknesses. This is demonstrated in FIG. 4, where curve A illustrates the return loss of the unmatched transition of FIGS. 1 and 2, curve B illustrates the return loss of the transition of FIGS. 5 and 6, and curve C illustrates the return loss of another embodiment, illustrated in FIGS. 7 and 8 and described more fully below.

The iterative simulation process for selecting the proper layer 84 thickness and/or dielectric constant for the optimum match in a given application can also be accomplished by a commercially available software package, EMPIPE3D, available from Optimization Systems Associates, Inc. This software, used with the high frequency structure simulation software, can help speed up the process of obtaining the optimum solution.

There is another advantage for this invention in that the dielectric ring and the center conductor can be said to have "dual" characteristics. In other words, if the dielectric ring in some cases may not have the exact dielectric constant desired, then providing a metal ring of equal length as the dielectric layer 84 to be part of the square-ax center conductor will provide similar performance. This is seen in FIG. 3 at curve C. The reason the matching transition has a "dual" characteristic can be seen by examining the coaxial impedance formula:

$$Z_0=(60/(e_r)^{1/2})\ (\ln(b/a)$$

where a is the inner conductor diameter, b is the outer conductor diameter, and $e_r$ is the relative dielectric constant of the coaxial dielectric. Applying this to the square-ax transmission line, (not exact), then for $e_r$=6, a=0.035 inch, and b=0.116 inch, $$Z_0=(60/(6)^{1/2})\ \ln(0.116/0.035)\cong 30 \text{ ohms.}$$

Now, assume that the same dielectric constant $e_r$=2.54 is used for both the dielectric layer and the square-ax dielectric, and that the dimension "a" is increased from 0.035 inch to 0.052 inch, from the following calculation.

$$Z_0=((60/(2.54)^{1/2})\ \ln\ (0.116/0.052)=30 \text{ ohms}$$

The embodiment of FIGS. 5 and 6 employs a square-ax line section 60', which has a square cross-sectional configuration for the dielectric and outer conductive shield, and which has a center conductor with a circular cross-sectional configuration. However, in a general sense, the section 60' can be a rectangular coaxial transmission line, wherein the adjacent outer side lengths need not be equal, and which may include center conductors of various shapes, e.g. circular or rectangular in cross-section.

Figure 7:
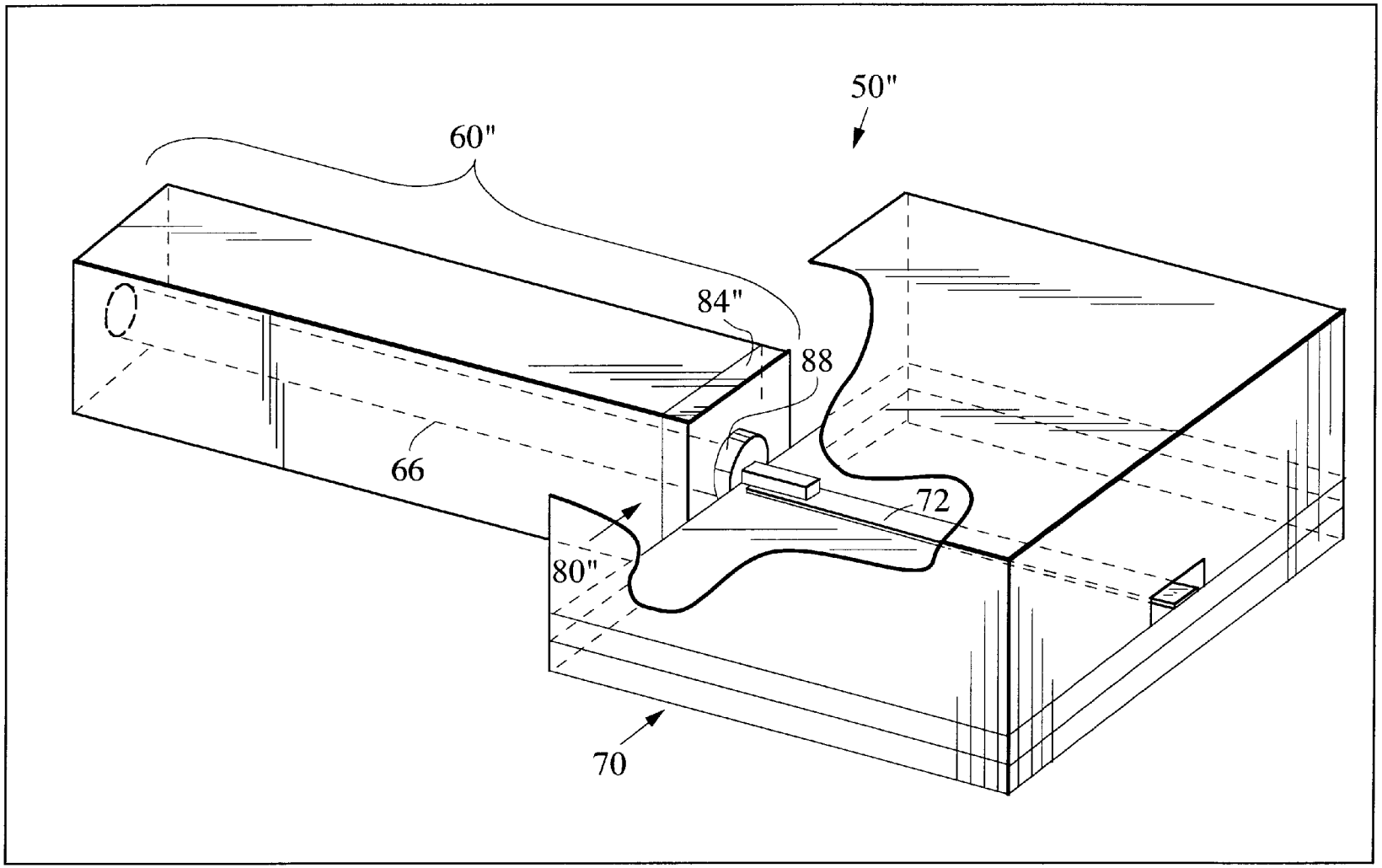
FIG. 7 is an isometric view of an RF circuit including a square-ax transmission line, a microstrip transmission line, and a transition between the two transmission line with an alternate matching element in accordance with an aspect of the invention.
Figure 8:
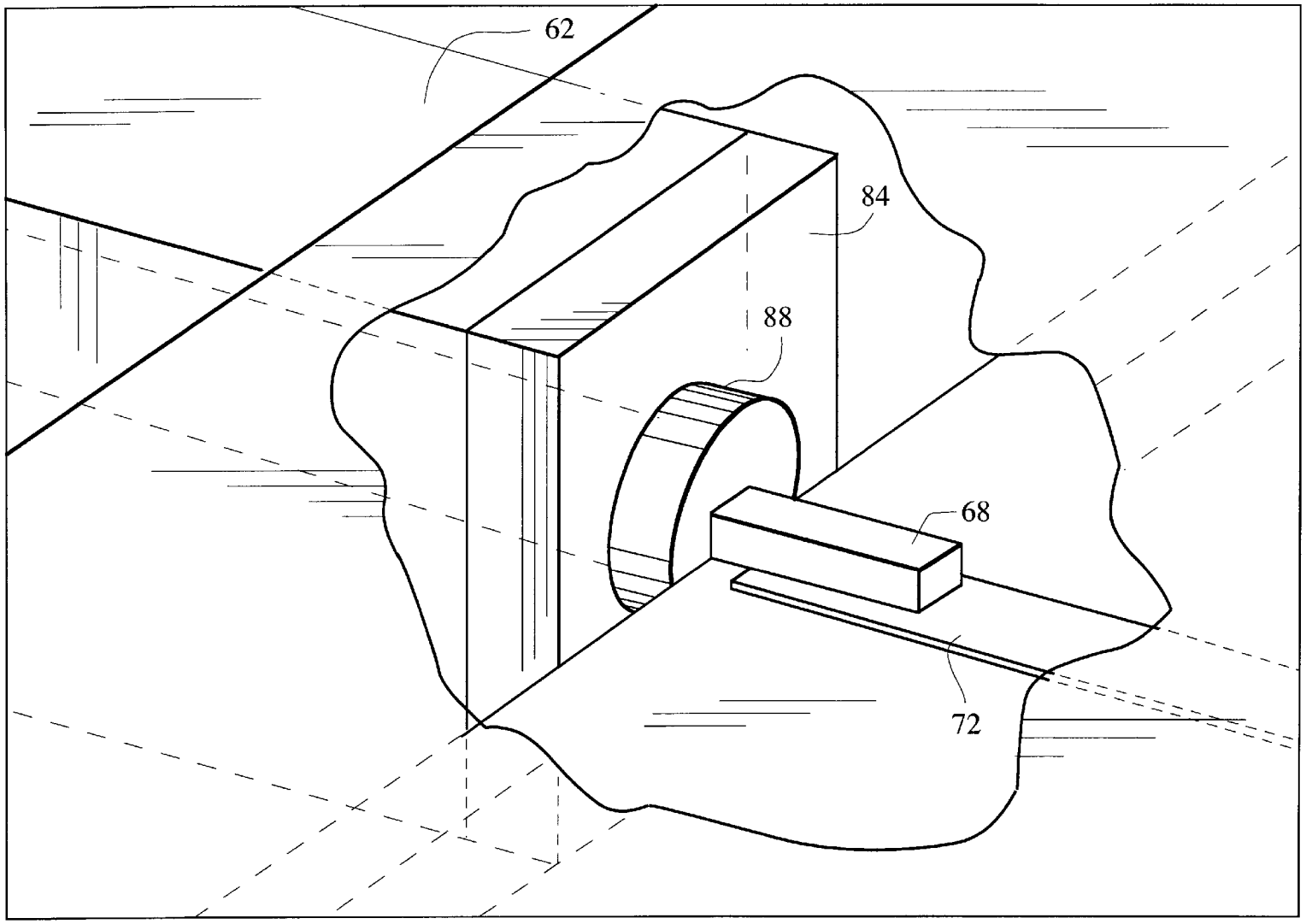
FIG. 8 is an enlarged view of the transition section of the circuit of FIG. 7.

An alternate embodiment of the invention is illustrated in FIGS. 7 and 8. The circuit 50" includes a square-ax section 60", a microstrip section 70, and a transition section 80". In this embodiment, the transition section 80" includes a section 88 of increased diameter of the square-ax center conductor 66. In this example, the diameter of section 88 is 0.052 inch, with the square-ax conductor 66 diameter at 0.035 inch. This section of increased diameter can be realized by a metal ring having an inner opening diameter sized to slip onto the center conductor 66, or alternatively, the center conductor can be fabricated as an integral element with an end section having the increased diameter. The transition section includes the tab 68 protruding from the end of the center conductor 66 as in the embodiment of FIG. 1. The transition section 80" is shown as including a separate section 84" of the dielectric material, which in this exemplary embodiment is the same material as used to form the dielectric section 62 of the square-ax transmission line. In other implementations, a separate section 84" will not be used, and the end of section 62 will have an opening of increased cross-sectional dimension to accommodate the increase in dimension of the center conductor.

It will be apparent that the particular dimensions for the transmission lines and transition sections are exemplary, and that other sizes of square-ax and microstrip transmission lines can be employed in accordance with the invention. Another example of a square-ax transmission line is a 0.057 inch by 0.116 inch square-ax transmission line with a center conductor of 0.020 inch, and a matching metal ring 0.029 inch in diameter.

The transition embodiment of FIGS. 7 and 8 may have a cost advantage over the embodiment of FIGS. 5 and 6, because this embodiment will have less parts to fabricate. Since the dielectric ring 84" has the same dielectric constant as the square-ax dielectric 62, this ring can become part of the square-ax dielectric. And the metal ring can be machined such that it becomes part of the center conductor. Due to having "dual" design characteristic between the dielectric ring and the metal ring this invention not only has advantages over the prior art but also offers flexibility for particular hardware implementations.

Figure 9:
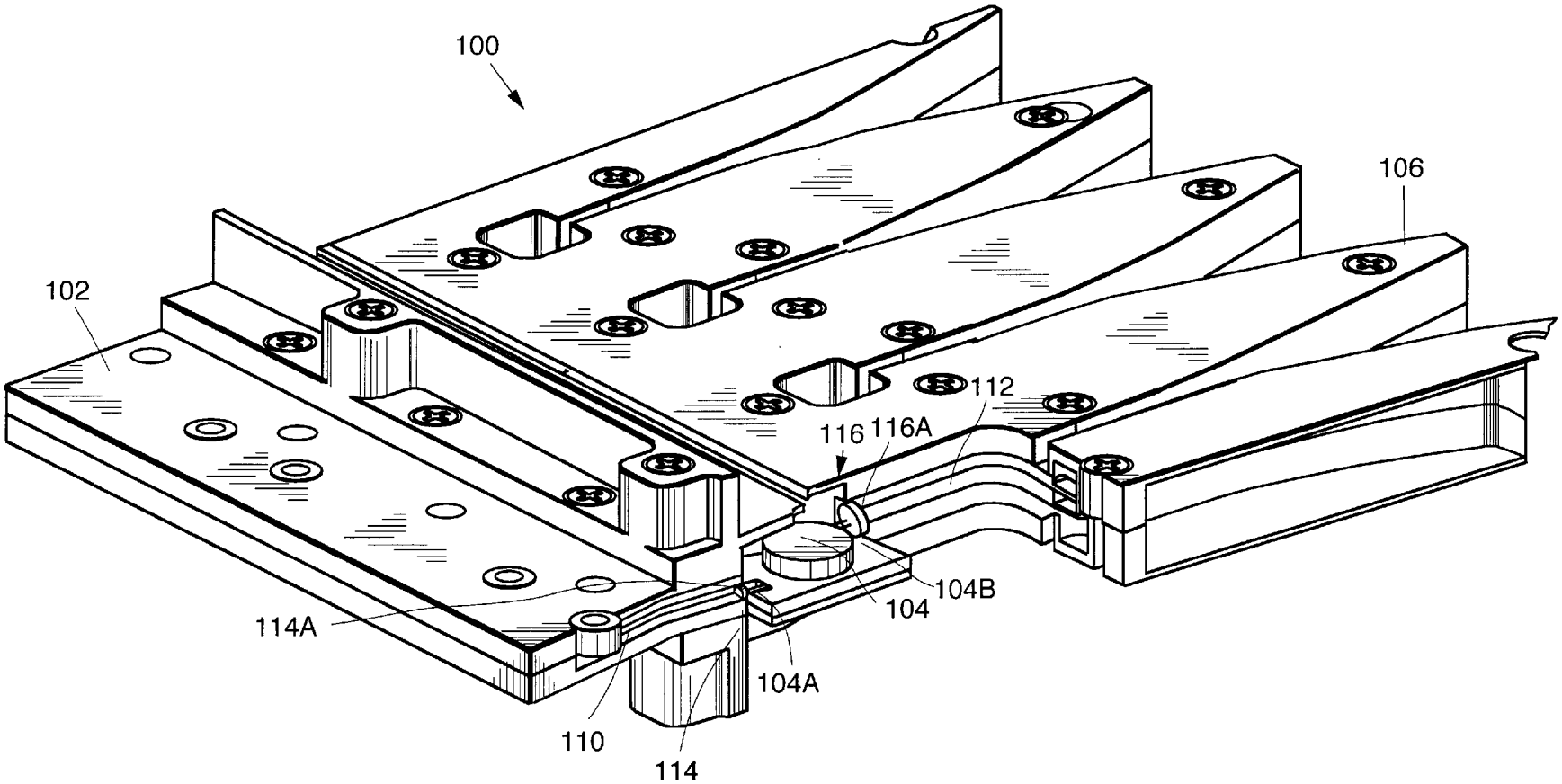
FIG. 9 is a partially broken-away isometric view of an exemplary application of this invention in an antenna subarray.

FIG. 9 is a partially broken-away isometric view of an exemplary application of this invention in an antenna subarray 100 which includes the transmit/receive (T/R) modules shown as 102, circulators 104, and the flared notch radiators 106. The circulators include microstrip input/output lines 104A, 104B, to which respective rectangular coaxial transmission lines 110, 112 from the T/R modules and the radiators are connected. Transitions 114, 116 between the respective rectangular coaxial and microstrip transmission lines are made in accordance with this invention. As shown at both the input and output of the circulator 104, the microstrip to rectangular coaxial transitions 114 and 116 both have a matching metal ring or area 114A, 116A of increased cross-section dimension of the coaxial conductor at the transition. In this exemplary embodiment, the rectangular coaxial transmission line 110 has an outer shield size of 0.057 inch by 0.116 inch, with a center conductor diameter of 0.020 inch and a metal ring diameter of 0.029 inch. The rectangular coaxial transmission line 112 has an outer shield size of 0.116 inch by 0.116 inch, a center conductor diameter of 0.035 inch, and a metal ring diameter of 0.052 inch.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A microwave circuit, comprising:

a rectangular coaxial transmission line section including a rectangular dielectric member having a rectilinear cross-sectional configuration and a coaxial center conductor extending through an opening formed in the dielectric member, said rectangular coaxial transmission line section characterized by a first characteristic impedance;

a microstrip transmission line section including a dielectric substrate having a microstrip conductor line defined on a first surface of the substrate and a ground plane formed on a second surface of the substrate, said microstrip transmission line section characterized by a second characteristic impedance substantially equal to the first characteristic impedance; and a wideband transition section for electrically connecting the rectangular coaxial transmission line section and the microstrip transmission line section at a transition junction, said transition section including a conductive element in electric contact between the coaxial center conductor and the microstrip conductor line, and a matching capacitive section for canceling inductance resulting from physical discontinuities at the transition junction;

wherein said rectangular coaxial dielectric section is fabricated of a first dielectric material having a first dielectric constant, and the matching capacitive section includes a thin transition dielectric section of cross-sectional configuration matching a cross-sectional configuration of said rectangular coaxial dielectric section, said transition dielectric section fabricated of a second dielectric material having a second dielectric constant, and wherein said second dielectric constant is greater than said first dielectric constant, and wherein said transition dielectric section has a thickness in the range between 0.025 wavelength and 0.05 wavelength in the second dielectric material at a center frequency of operation of the microwave circuit.

2. The circuit of claim 1 wherein the transition section includes a transition center conductor section concentric with and of equal cross-sectional size and configuration to the coaxial conductor.

3. The circuit of claim 2 wherein said conductive member is a tab element extending from an end of said transition center conductor section.

4. A microwave circuit, comprising:

a rectangular coaxial transmission line section including a rectangular dielectric member having a rectilinear cross-sectional configuration and a coaxial center conductor extending through an opening formed in the dielectric member, said rectangular coaxial transmission line section characterized by a first characteristic impedance;

a microstrip transmission line section including a dielectric substrate having a microstrip conductor line defined on a first surface of the substrate and a ground plane formed on a second surface of the substrate, said microstrip transmission line section characterized by a second characteristic impedance substantially equal to the first characteristic impedance; and a wideband transition section for electrically connecting the rectangular coaxial transmission line section and the microstrip transmission line section at a transition junction, said transition section including a conductive element in electric contact between the coaxial center conductor and the microstrip conductor line, and a matching capacitive section for canceling inductance resulting from physical discontinuities at the transition junction;

wherein said coaxial center conductor has a circular cross-sectional configuration with a first diameter, and said matching capacitive section includes a transition center conductor section of circular cross-sectional configuration with a second diameter, and wherein said second diameter is great than said first diameter to provide said capacitance.

5. The circuit of claim 4 wherein said transition section further includes a transition dielectric section having a dielectric constant equivalent to a dielectric constant of said rectangular coaxial dielectric section.

6. The circuit of claim 4 wherein said transition center conductor section is defined by said rectangular coaxial conductor and a conductive ring fitted over an end of said rectangular coaxial conductor.

7. A microwave circuit, comprising:

a rectangular coaxial transmission line section including a rectangular dielectric member having a rectilinear cross-sectional configuration and a coaxial center conductor extending through an opening formed in the dielectric member, said rectangular coaxial transmission line section characterized by a first characteristic impedance;

a microstrip transmission line section including a dielectric substrate having a microstrip conductor line defined on a first surface of the substrate and a ground plane formed on a second surface of the substrate, said microstrip transmission line section characterized by a second characteristic impedance substantially equal to the first characteristic impedance; and a wideband transition section for electrically connecting the rectangular coaxial transmission line section and the microstrip transmission line section at a transition junction, said transition section including a conductive element in electric contact between the coaxial center conductor and the microstrip conductor line, and a matching capacitive section for canceling inductance resulting from physical discontinuities at the transition junction;

wherein said transition section has a dimension along an axis of said rectangular coaxial section which is in the range of 0.025 wavelength and 0.05 wavelength at a center frequency of operation of the circuit.

8. A microwave circuit, comprising:

a square-ax transmission line section including a square-ax dielectric member having a rectilinear cross-sectional configuration and a square-ax center conductor extending through an opening formed in the dielectric member, said square-ax transmission line section characterized by a first characteristic impedance;

a microstrip transmission line section including a dielectric substrate having a microstrip conductor line defined on a first surface of the substrate and a ground plane formed on a second surface of the substrate, said microstrip transmission line section characterized by a second characteristic impedance substantially equal to the first characteristic impedance; and a wideband transition section for electrically connecting the square-ax transmission line section and the microstrip transmission line section at a transition junction, said transition section including a conductive element in electric contact between the square-ax center conductor and the microstrip conductor line, and a matching capacitive section for canceling inductance resulting from physical discontinuities at the transition junction;

wherein the square-ax dielectric section is fabricated of a first dielectric material having a first dielectric constant, and the matching capacitive section includes a thin transition dielectric section of cross-sectional configuration matching a cross-sectional configuration of said square-ax dielectric section, said transition dielectric section fabricated of a second dielectric material having a second dielectric constant, and wherein said second dielectric constant is greater than said first dielectric constant, and wherein said transition dielectric section has a thickness in the range between 0.025 wavelength and 0.05 wavelength in the second dielectric material at a center frequency of operation of the microwave circuit.

9. The circuit of claim 8 wherein the transition section includes a transition center conductor section concentric with and of equal diameter of the square-ax conductor.

10. The circuit of claim 8 wherein said conductive member is a tab element extending from an end of said transition center conductor section.

11. The circuit of claim 8 wherein said square-ax center conductor has a first diameter, and said matching capacitive section includes a transition center conductor section having a second diameter, and wherein said second diameter is greater than said second diameter to provide said capacitance.

12. The circuit of claim 11 wherein said transition section further includes a transition dielectric section having a dielectric constant equivalent to a dialectic constant of said square-ax section.

13. The circuit of claim 11 wherein said transition center conductor section is defined by said square-ax conductor and a conductive ring fitted over an end of said square-ax conductor.

14. A microwave circuit, comprising:

a square-ax transmission line section including a square-ax dielectric member having a rectilinear cross-sectional configuration and a square-ax center conductor extending through an opening formed in the dielectric member, said square-ax transmission line section characterized by a first characteristic impedance;

a microstrip transmission line section including a dielectric substrate having a microstrip conductor line defined on a first surface of the substrate and a ground plane formed on a second surface of the substrate, said microstrip transmission line section characterized by a second characteristic impedance substantially equal to the first characteristic impedance; and a wideband transition section for electrically connecting the square-ax transmission line section and the microstrip transmission line section at a transition junction, said transition section including a conductive element in electric contact between the square-ax center conductor and the microstrip conductor line, and a matching capacitive section for canceling inductance resulting from physical discontinuities at the transition junction;

wherein said transition section has a dimension along an axis of said rectangular coaxial section which is in the range of 0.025 wavelength and 0.05 wavelength at a center frequency of operation for the circuit.

15. An antenna subarray including:

a plurality of transmit/receive (T/R) modules, each module including a first rectangular coaxial transmission line;

a plurality of antenna radiator elements, each radiator element including a second rectangular coaxial transmission line;

each of said first and second rectangular coaxial transmission lines including a rectangular coaxial dielectric member having a rectilinear cross-sectional configuration and a rectangular coaxial center conductor extending through an opening formed in the dielectric member;

a plurality of circulators, each circulator for coupling signals between a T/R module and a corresponding radiator element, each circulator including first and second microstrip input/output lines, each line including a microstrip conductor on a dielectric substrate, to which respective first and second rectangular coaxial transmission lines from a corresponding T/R module and a corresponding radiator are coupled; and a plurality of transitions, each transition for providing a matched transition at a junction between a respective rectangular coaxial transmission line and a microstrip transmission line, each transition including a conductive element in electric contact between a coaxial center conductor and a microstrip conductor line, and a matching capacitive section for canceling inductance resulting from a physical discontinuity at the junction;

wherein said rectangular coaxial dielectric member is fabricated of a first dielectric material having a first dielectric constant, and the capacitive section includes a transition dielectric section of cross-sectional configuration matching a cross-sectional configuration of said rectangular dielectric section, said transition dielectric section fabricated of a second dielectric material having a second dielectric constant, and wherein said second dielectric constant is greater than said first dielectric constant.

16. The subarray of claim 15 wherein the transition section includes a transition center conductor section concentric with and of equal diameter to the rectangular coaxial conductor.

17. An antenna subarray including:

a plurality of transmit/receive (T/R) modules, each module including a first rectangular coaxial transmission line;

a plurality of antenna radiator elements, each radiator element including a second rectangular coaxial transmission line;

each of said first and second rectangular coaxial transmission lines including a rectangular coaxial dielectric member having a rectilinear cross-sectional configuration and a rectangular coaxial center conductor extending through an opening formed in the dielectric member;

a plurality of circulators, each circulator for coupling signals between a T/R module and a corresponding radiator element, each circulator including first and second microstrip input/output lines, each line including a microstrip conductor on a dielectric substrate, to which respective first and second rectangular coaxial transmission lines from a corresponding T/R module and a corresponding radiator are coupled; and a plurality of transitions, each transition for providing a matched transition at a junction between a respective rectangular coaxial transmission line and a microstrip transmission line, each transition including a conductive element in electric contact between a coaxial center conductor and a microstrip conductor line, and a matching capacitive section for canceling inductance resulting from a physical discontinuity at the junction;

wherein said coaxial center conductor has a circular cross-sectional configuration with a first diameter, and said capacitive section includes a transition center conductor section having a circular cross-sectional configuration with a second diameter, and wherein said second diameter is greater than said first diameter to provide said capacitance.

18. The subarray of claim 17 wherein said transition section further includes a transition dielectric section having a dielectric constant equivalent to a dielectric constant of said square-ax section.

* * * * *